US008558125B2

(12) United States Patent
Kano

(10) Patent No.: US 8,558,125 B2
(45) Date of Patent: Oct. 15, 2013

(54) BUTTON-KEY STRUCTURE AND ELECTRIC DEVICE HAVING THE SAME

(75) Inventor: Hiromi Kano, Tokyo (JP)

(73) Assignee: Oki Data Corporation, Tokyo (JP)

( * ) Notice: Subject to any disclaimer, the term of this patent is extended or adjusted under 35 U.S.C. 154(b) by 403 days.

(21) Appl. No.: 12/615,468

(22) Filed: Nov. 10, 2009

(65) Prior Publication Data

US 2010/0116637 A1 May 13, 2010

(30) Foreign Application Priority Data

Nov. 12, 2008 (JP) ..... 2008-289478

(51) Int. Cl.
*H01H 9/26* (2006.01)
*H01H 13/72* (2006.01)
*H01H 13/76* (2006.01)

(52) U.S. Cl.
USPC ..... 200/5 A; 200/345

(58) Field of Classification Search
USPC ..... 200/5 A
See application file for complete search history.

(56) References Cited

U.S. PATENT DOCUMENTS 5,172,114 A * 12/1992 Bedoya et al. ..... 341/27
7,332,681 B2 * 2/2008 Wohlfart ..... 200/5 A

FOREIGN PATENT DOCUMENTS

JP 60-110933 U 7/1985
JP 2001-236852 A 8/2001
JP 2002-324454 A 11/2002
JP 3105098 U 8/2004

* cited by examiner

*Primary Examiner* — R S Luebke
*Assistant Examiner* — Lheiren Mae Caroc
(74) *Attorney, Agent, or Firm* — Kubotera & Associates, LLC

(57) ABSTRACT

A button-key structure includes a plurality of button-keys arranged next to each other; and a button-key supporting portion disposed on a downstream side in a direction that the button-keys move. The button-key supporting portion includes a guide portion disposed between the button-keys in parallel to the direction that the button-key move.

18 Claims, 19 Drawing Sheets

BUTTON-KEY STRUCTURE AND ELECTRIC DEVICE HAVING THE SAME

BACKGROUND OF THE INVENTION AND RELATED ART STATEMENT

The present invention relates to a button-key structure and an electric device having the button-key structure. More specifically, the present invention relates to a button-key structure disposed in an operation panel of an electric device such as a copier, a printer, a facsimile, a personal computer, a telephone, a game machine, and the likes.

A conventional operation panel of an electric device such as a copier, a printer, a facsimile, a personal computer, a telephone, a game machine, and the likes is provided with various button-keys for operating the electric device. The button-keys include a selection key for receiving a selection of various settings of the electric device; an input key for receiving an input; and a back key for receiving an input for retuning to a previous process. The various button-keys with different functions are generally arranged with next to each other in view of a design or a function. Further, the various button-keys are connected to a frame through an elastic arm, thereby being supported (refer to Patent Reference).

Patent Reference: Japanese Patent Publication No. 2001-236852

In the conventional operation panel with the button-keys described above, when a user pushes one of the button-keys, another of the button-keys arranged adjacent to the one of the button-keys may inadvertently moves and contacts due to deformation of the elastic arm. Accordingly, the one of the button-keys may not properly contact with a switch disposed below the one of the button-keys.

In view of the problems described above, an object of the present invention is to provide a button-key structure and an electric device having the button-key structure capable of solving the problems. In the button-key structure, it is possible to push a button-key in a wide range of a downward direction. Accordingly, even when the button-key is pushed down in an oblique direction, it is possible to smoothly push the button-key without moving or interfering with another button-key arranged next to the button-key.

Further objects and advantages of the invention will be apparent from the following description of the invention.

SUMMARY OF THE INVENTION

In order to attain the objects described above, according to a first aspect of the present invention, a button-key structure includes a plurality of button-keys arranged next to each other and a button-key supporting portion disposed on a downstream side in a direction that the button-keys move. The button-key supporting portion includes a guide portion disposed between the button-keys in parallel to the direction that the button-key move.

According to a second aspect of the present invention, an electric device includes a button-key structure. The button-key structure includes a plurality of button-keys arranged next to each other and a button-key supporting portion disposed on a downstream side in a direction that the button-keys move. The button-key supporting portion includes a guide portion disposed between the button-keys in parallel to the direction that the button-key move.

According to a third aspect of the present invention, a button-key structure includes a first button-key arranged to be movable in a first direction; a second button-key arranged adjacent to the first button-key to be movable in the first direction; and a button-key supporting portion disposed on a downstream side of the first button-key and the second button-key in the first direction. The button-key supporting portion includes a wall portion disposed between the first button-key and the second button-key and extending in the first direction.

In the button-key structure of the present invention, it is possible to push the button-key in a wide range of a downward direction. Accordingly, even when the button-key is pushed down in an oblique direction, it is possible to smoothly push the button-key without moving or interfering with another button-key arranged next to the button-key.

In the electric device having the button-key structure of the present invention, it is possible to push the button-key in a wide range of a downward direction. Accordingly, even when the button-key is pushed down in an oblique direction, it is possible to smoothly push the button-key without moving or interfering with another button-key arranged next to the button-key.

BRIEF DESCRIPTION OF THE DRAWINGS

FIG. 19(*b*) showing an entire supporting structure of the button-key structure taken along a line 19-19' in FIG. 19(*a*) according to the second embodiment of the present invention.

DETAILED DESCRIPTION OF THE PREFERRED EMBODIMENTS

Hereunder, embodiments of the present invention will be explained with reference to the accompanying drawings.

First Embodiment

A first embodiment of the present invention will be explained. In the following description, a printer 101 will be explained first as an electric device having a button-key structure of the present invention. Then, the button-key structure will be explained.

Figure 1:
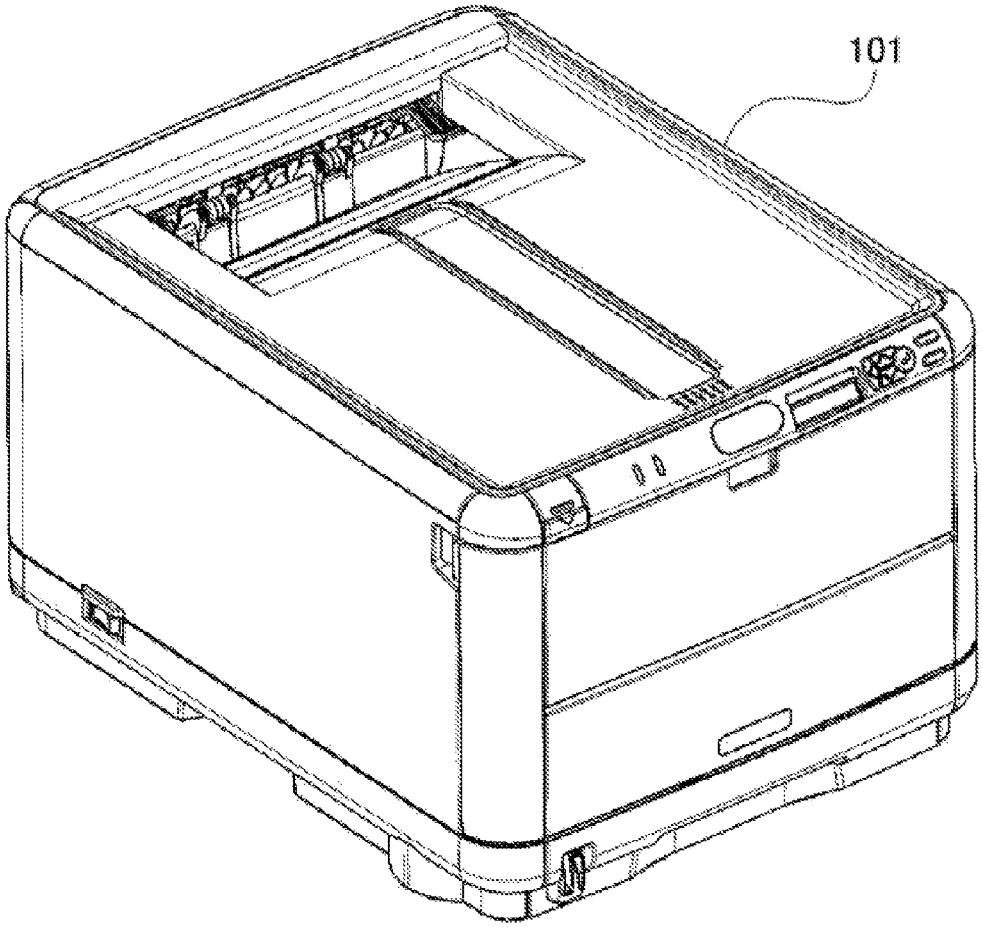
FIG. 1 is a perspective view showing a printer according to a first embodiment of the present invention.

FIG. 1 is a perspective view showing the printer 101 according to the first embodiment of the present invention.

Figure 2:
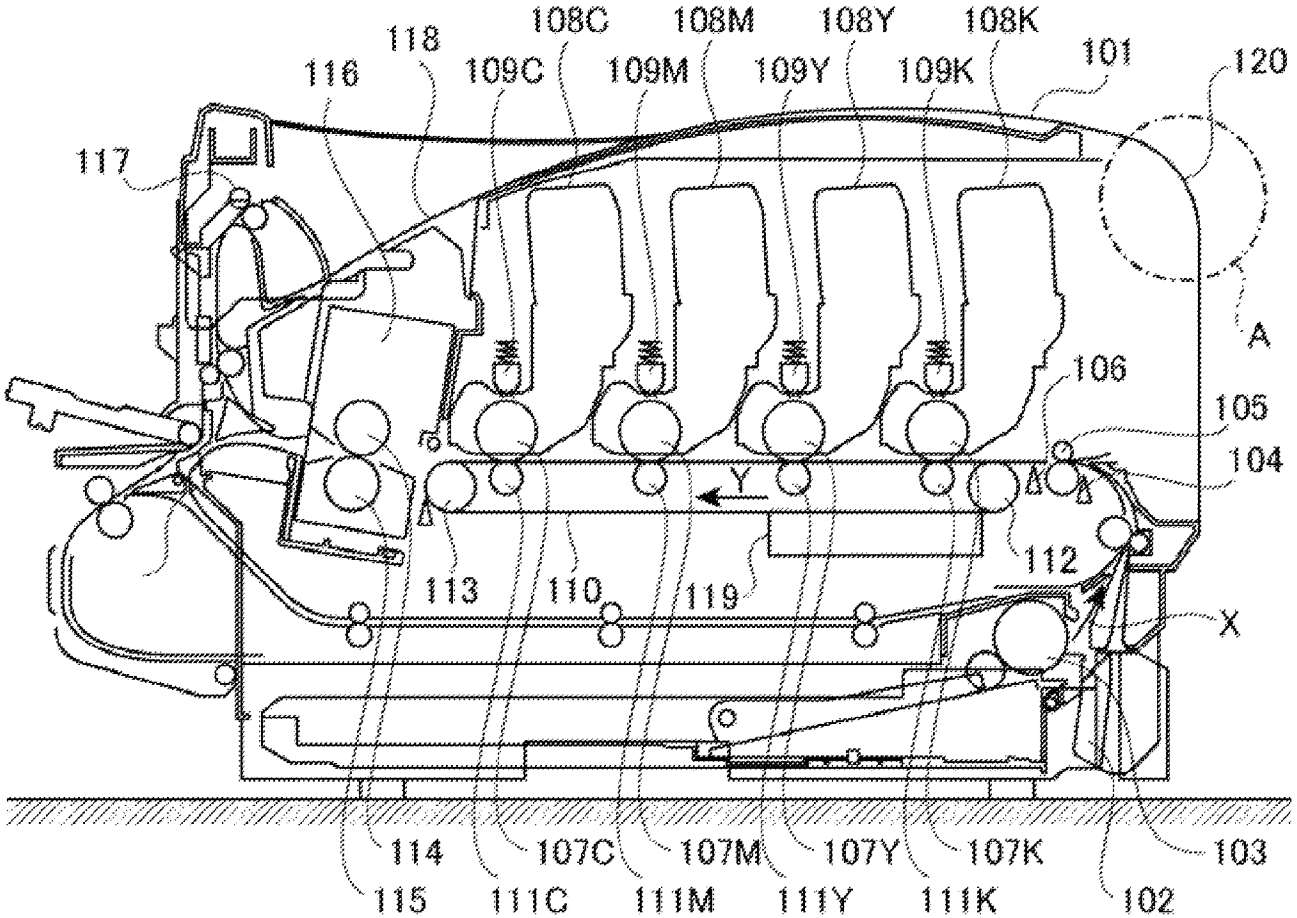
FIG. 2 is a schematic sectional view showing a detailed configuration of the printer according to the first embodiment of the present invention.

FIG. 2 is a schematic sectional view showing a detailed configuration of the printer 101 according to the first embodiment of the present invention.

As shown in FIG. 2, the printer 101 includes a sheet cassette 102 for placing a sheet as a recording medium; a sheet supply roller 103 for transporting the sheet in an arrow direction X; an inlet sensor 104 for detecting the sheet transported with the sheet supply roller 103; a transport roller 105 for correcting skew of the sheet and transporting the sheet to image forming units 108; a writing sensor 106 for detecting the sheet transported with the transport roller 105.

In the embodiment, the printer 101 further includes the image forming units 108 (108K, 108Y, 108M, 108C) having photosensitive drums 107 (107K, 107Y, 107M, 107C) for forming developer images according to input print data; LED (Light Emitting Diodes) heads 109 (109K, 109Y, 109M, 109C) for forming static latent images on surfaces of the photosensitive drums 107 (107K, 107Y, 107M, 107C); a transfer belt 110 for attaching the sheet through static electricity and transporting the sheet in an arrow direction Y; transfer rollers 111 (111K, 111Y, 111M, 111C) for transferring the developer images formed in the image forming units 108 (108K, 108Y, 108M, 108C) to the sheet; and a belt idle roller 112 and a belt drive roller 113 for driving the transfer belt 110.

In the embodiment, the printer 101 further includes a fixing unit 116 having a fixing roller 114 and a backup roller 115 for applying heat and pressure to the sheet transported with the transfer belt 110 to fix the developer images thus transferred; a discharge roller 117 for discharging the sheet passing through the fixing unit 116 to outside the printer 101; a sheet stacker 118 for placing the sheet discharged with the discharge roller 117; a waste toner box 119 for collecting toner as developer remaining on the transfer belt 110; and an operation panel 120 for receiving an operation input of the printer 101 from an operator. Each component described above except the operation panel 120 is arranged along a sheet transportation path formed substantially in an S character shape.

In the embodiment, the sheet cassette 102 is detachably attached to a lower portion of the printer 101, so that the sheet cassette 102 retains the sheet in a stacked state. The sheet supply roller 103 is disposed at an upper portion of the sheet cassette 102 for separating and picking up the sheet one by one. The sheet supply roller 103 is arranged at a start end side of the sheet transportation path. A drive source (not shown) drives the sheet supply roller 103 to rotate, so that the sheet picked up from the sheet cassette 102 is transported in the arrow direction X.

In the embodiment, the inlet sensor 104 detects a leading edge of the sheet, and notifies a detection result to a print control unit (not shown). The inlet sensor 104 is not limited to any particular sensor, and may be formed of a photo interrupter of a light transmission type or a light reflection type.

In the embodiment, the transport roller 105 is provided for correcting skew of the sheet. Further, a drive source (not shown) drives the transport roller 105 to rotate, so that the sheet is transported to the image forming units 108 (108K, 108Y, 108M, 108C).

In the embodiment, similar to the inlet sensor 104, the writing sensor 106 detects the leading edge of the sheet, and notifies a detection result to the print control unit (not shown). When the print control unit receives the detection result, the print control unit controls the image forming units 108 (108K, 108Y, 108M, 108C) to start forming an image.

In the embodiment, each of the photosensitive drums 107 (107K, 107Y, 107M, 107C) is formed of a conductive supporting member and a photo conductive layer. More specifically, each of the photosensitive drums 107 (107K, 107Y, 107M, 107C) is an organic photosensitive member, in which a charge generation layer and a charge transportation layer as the photo conductive member are sequentially laminated on a metal pipe formed of aluminum as the conductive supporting member. A charge roller (not shown) uniformly charges a surface of each of the photosensitive drums 107 (107K, 107Y, 107M, 107C), so that the LED heads 109 (109K, 109Y, 109M, 109C) irradiate to form the static latent images.

In the image forming units 108 (108K, 108Y, 108M, 108C), the static latent images are formed on the surfaces of the photosensitive drums 107 (107K, 107Y, 107M, 107C). Then, the static latent images are developed with developer or toner corresponding to four colors of black (K), yellow (Y), magenta (M), and cyan (C), thereby forming the developer images.

In the embodiment, the image forming units 108 (108K, 108Y, 108M, 108C) include the photosensitive drums 107 (107K, 107Y, 107M, 107C), respectively. Further, the image forming units 108 (108K, 108Y, 108M, 108C) include the charge rollers for uniformly charging the surfaces of the photosensitive drums 107 (107K, 107Y, 107M, 107C); developing rollers for supplying toner to the photosensitive drums 107 (107K, 107Y, 107M, 107C); and toner supply rollers for supplying toner to the developing rollers. The image forming units 108 (108K, 108Y, 108M, 108C) are detachably arranged over the transfer belt 110 along the sheet transportation path.

In the embodiment, each of the LED heads 109 (109K, 109Y, 109M, 109C) includes an LED light emitting element and a lens array. The LED heads 109 (109K, 109Y, 109M, 109C) are arranged to irradiate the surfaces of the photosensitive drums 107 (107K, 107Y, 107M, 107C) according to the input print data, thereby forming the static latent images.

In the embodiment, the transfer belt 110 is an endless belt member for attaching and transporting the sheet. The belt idle roller 112 and the belt drive roller 113 extend end portions of the transfer belt 110. A drive source (not shown) drives the belt drive roller 113 to rotate, so that the transfer belt 110 moves in the arrow direction Y to transport the sheet.

In the embodiment, each of the transfer rollers 111 (111K, 111Y, 111M, 111C) is formed of a metal shaft and a semi-conductive rubber layer of an epichlorohydrin rubber and the likes. The transfer rollers 111 (111K, 111Y, 111M, 111C) are arranged to contact with the surfaces of the photosensitive drums 107 (107K, 107Y, 107M, 107C) through the transfer belt 110. When the transfer belt 110 moves, the transfer rollers 111 (111K, 111Y, 111M, 111C) rotate.

Further, a transfer roller power source (not shown) is connected to the transfer rollers 111 (111K, 111Y, 111M, 111C) for applying a bias voltage with a polarity opposite to that of toner. When the transfer roller power source (not shown) applies the bias voltage, the transfer rollers 111 (111K, 111Y, 111M, 111C) transfer the developer images formed on the photosensitive drums 107 (107K, 107Y, 107M, 107C) to the sheet.

In the embodiment, the fixing roller 114 and the backup roller 115 constitute a roller pair of the fixing unit 116. After the sheet passes through the image forming units 108 (108K, 108Y, 108M, 108C), the fixing unit 116 applies heat and pressure to toner on the sheet, thereby fixing the developer images. The fixing roller 114 is formed of a core shaft with a hollow cylindrical shape formed of aluminum; a heat resistant elastic layer formed of a silicone rubber and disposed on the core shaft; and a PFA (tetrafluoro perfluoroalkylvinylether copolymer) tube disposed on the heat resistant elastic layer. A heating heater such as a halogen lamp is disposed in the core shaft.

In the embodiment, the backup roller 115 is formed of a core shaft formed of aluminum; a heat resistant elastic layer formed of a silicone rubber and disposed on the core shaft; and a PFA tube disposed on the heat resistant elastic layer. The fixing roller 114 is pressed against the backup roller 115 to form a pressing portion. After the transfer rollers 111 (111K, 111Y, 111M, 111C) transfer the developer images to the sheet, when the sheet passes through the pressing portion, heat and pressure are applied to the sheet, thereby fixing the developer images.

In the embodiment, a drive source (not shown) drives the discharge roller 117 to rotate, so that the discharge roller 117 discharges the sheet to the sheet stacker 118 after the sheet passes through the fixing unit 116. The sheet stacker 118 is formed using an housing outer surface of the printer 101, and retains the sheet discharged from the discharge roller 117.

In the embodiment, the waste toner box 119 includes a cleaning blade (not shown) for scraping off toner remaining on the transfer belt 110, so that the waste toner box 119 collects waste toner collected from the transfer belt 110. The operation panel 120 is disposed on a front surface of the transfer belt 110, and functions as an interface for receiving an operation input of the printer 101 from an operator. The operation panel 120 will be explained in more detail later.

In the embodiment, in addition to the components described above, the printer 101 further includes the print control unit having a microprocessor, an ROM (Read Only Memory), an RAM (Random Access Memory), an input-output port, a timer, and the likes; an interface control unit for receiving print data and a control command and controlling an entire sequence of the printer 101 to perform a printing operation; and various sensors such as a temperature-humidity sensor and a density sensor for monitoring an operational state of the printer 101.

Further, the printer 101 includes a head drive control unit for controlling drive of the LED heads 109 (109K, 109Y, 109M, 109C); a temperature control unit for controlling a temperature of the fixing unit 116; a sheet transportation motor control unit for controlling a drive motor as a drive source for rotating each roller to transport the sheet; a drive control unit for controlling a drive motor for rotating each roller of the image forming units 108 (108K, 108Y, 108M, 108C); and a power source for applying a voltage to each roller.

With the configuration described above, according to an instruction that the operator inputs through the operation panel 120, the printer 101 is capable of forming an image of the print data thus received on the sheet.

Figure 3:
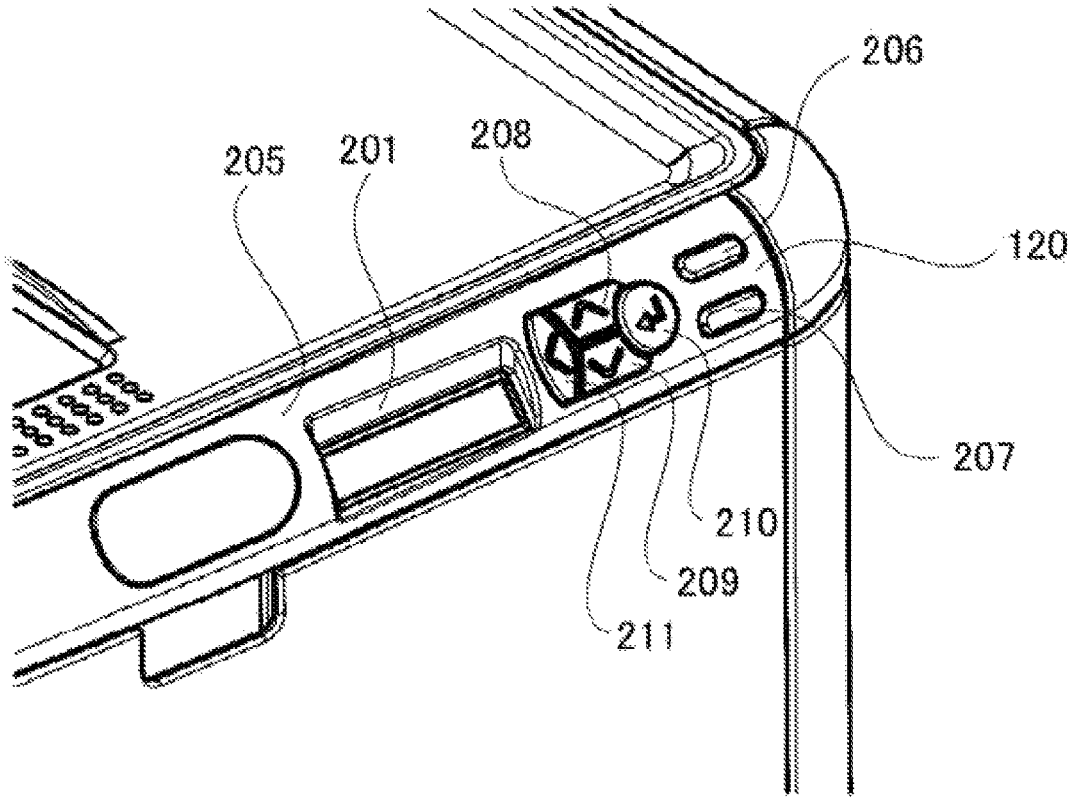
FIG. 3 is a perspective view showing an operation panel according to the first embodiment of the present invention.
Figure 4:
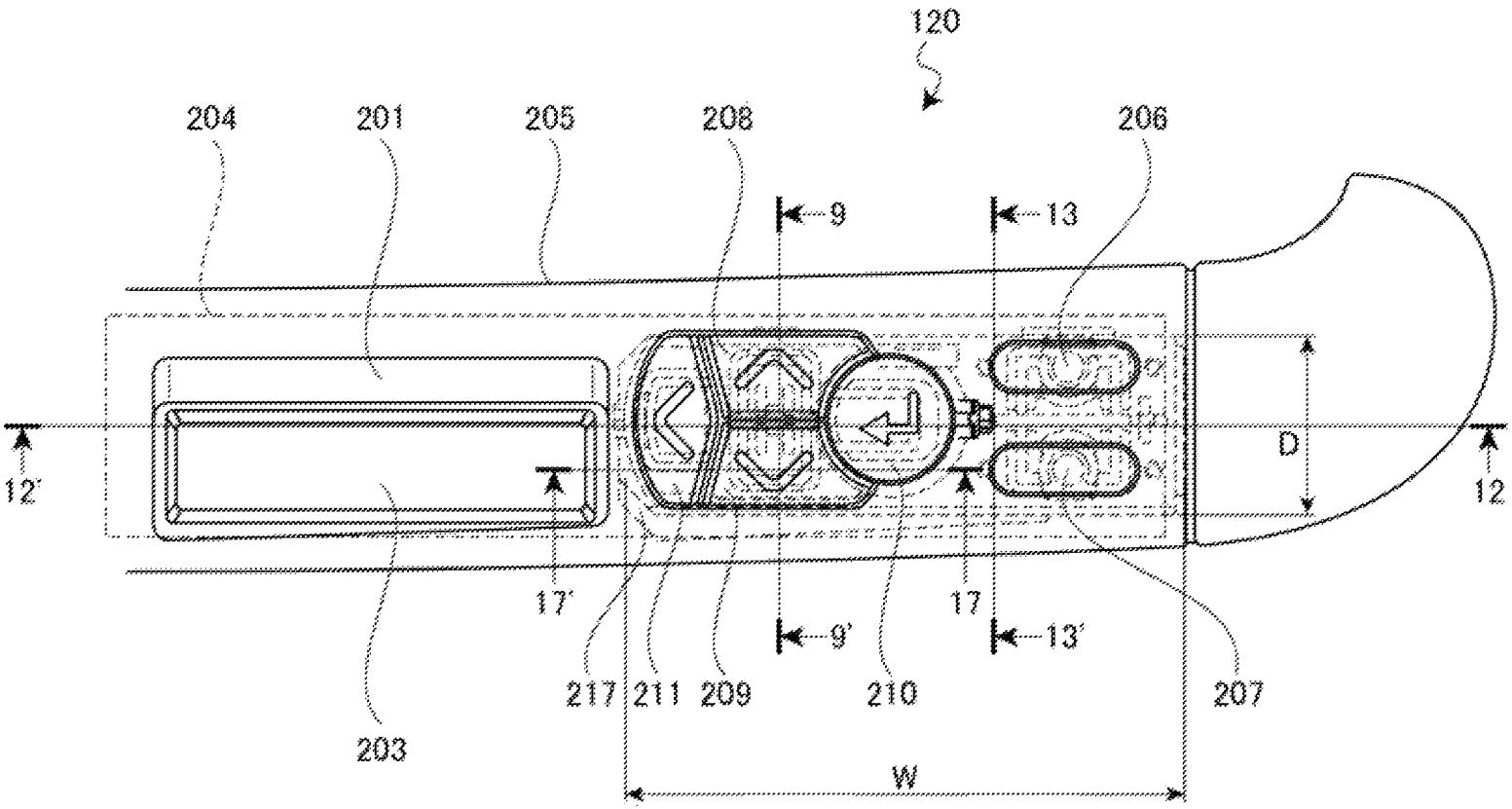
FIG. 4 is a front view showing the operation panel according to the first embodiment of the present invention.

A button-key structure of the operation panel 120 will be explained next. FIG. 3 is a perspective view showing the operation panel 120 according to the first embodiment of the present invention. FIG. 4 is a front view showing the operation panel 120 according to the first embodiment of the present invention.

As shown in FIGS. 3 and 4, the operation panel 120 includes a display portion 201 formed of an LCD (Liquid Crystal Display) and a display cover 203 for displaying the operational state and setting information of the printer 101; an online key 206 for the operator to push when the operator selects whether the printer 101 becomes a reception capable state for receiving the print data and the likes from a host device or a reception unable state; and a cancel key 207 for the operator to push when the operator stops the printing operation.

Further, the operation panel 120 includes an upper menu key 208 and a lower menu key 209 for the operator to push when the operator selects a print number and a setting of the sheet for the printing operation of the printer 101; an enter key 210 for the operator to push when the operator confirms the selection of the print number and the setting of the sheet selected with the upper menu key 208 and the lower menu key 209; and a back key 211 for the operator to push when the operator chooses to change a display screen on the display portion 201 from a current step to a previous step.

In the embodiment, a case member 205 as a cover member covers the display portion 201 and the button-keys such as the online key 206 and the likes. Further, the upper menu key 208, the lower menu key 209, the enter key 210, and the back key 211 are arranged in one single location next to each other.

Figure 5:
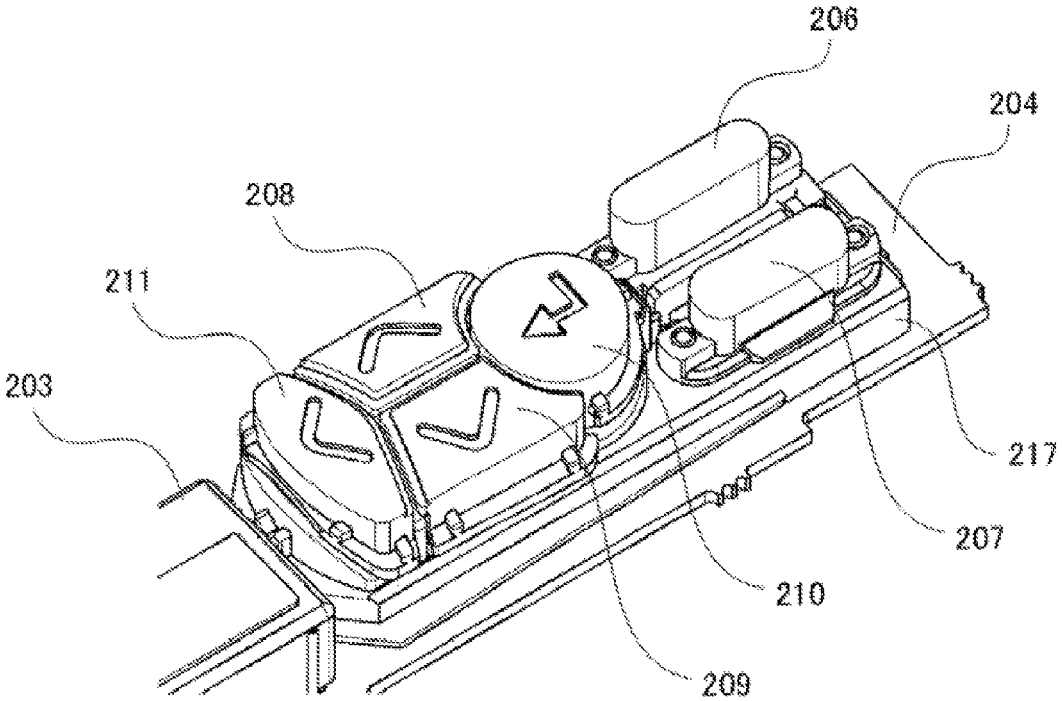
FIG. 5 is a perspective view showing a button-key structure according to the first embodiment of the present invention.
Figure 6:
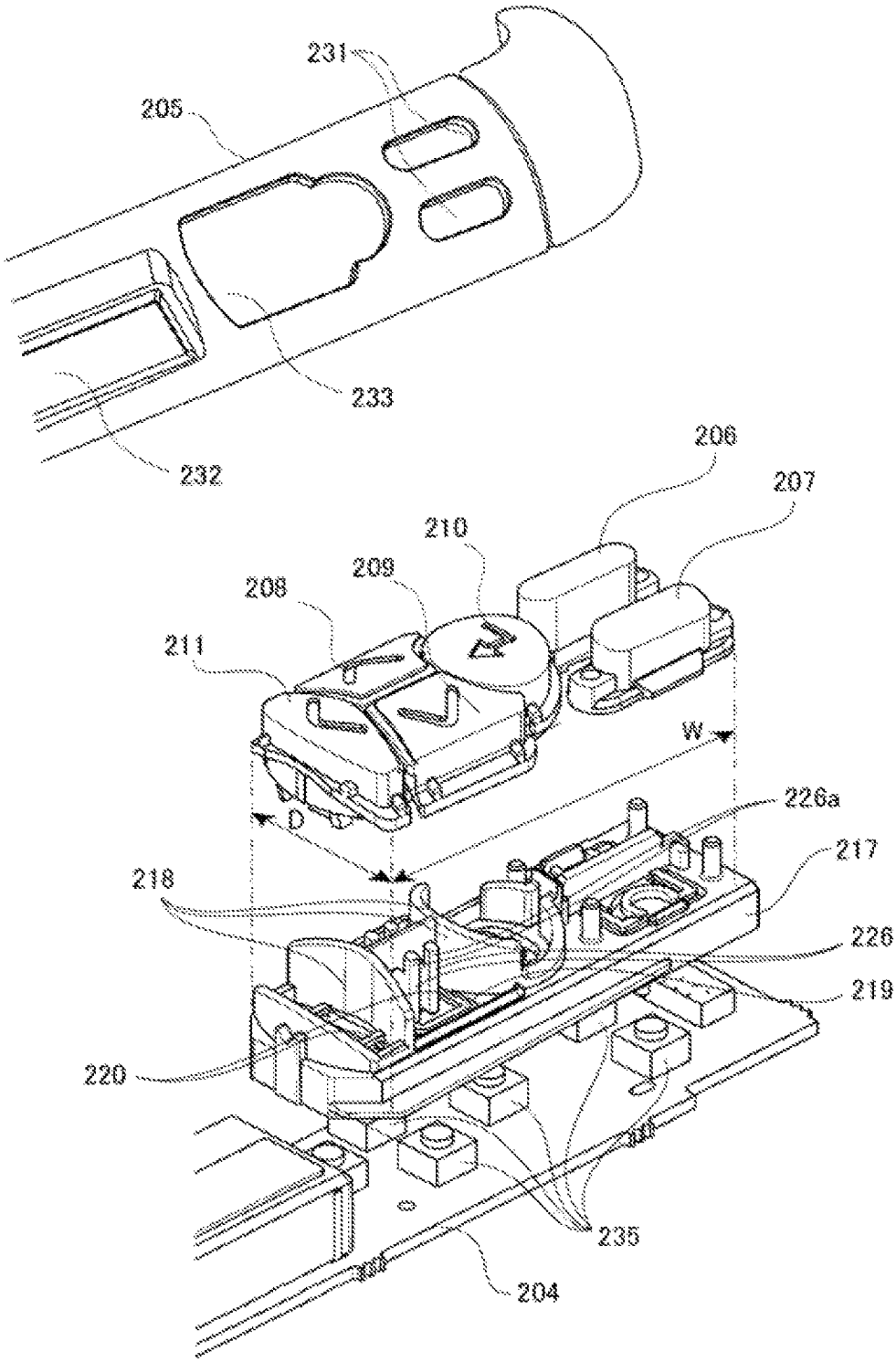
FIG. 6 is an exploded view showing the button-key structure according to the first embodiment of the present invention.

FIG. 5 is a perspective view showing the button-key structure according to the first embodiment of the present invention. FIG. 6 is an exploded view showing the button-key structure according to the first embodiment of the present invention.

As shown in FIGS. 5 and 6, the button-keys such as the online key 206 and the likes are arranged at positions corresponding to switches 235 disposed on a circuit board 204 through a button-key supporting portion 217. The circuit board 204 includes the switches 235 at the positions just below the button-keys such as the online key 206 and the likes, and controls information of the operation input when the button-keys such as the online key 206 and the likes are pushed.

Components of the button-key structure will be explained. As shown in FIG. 6, the case member 205 has button holes 231 at positions corresponding to the online key 206 and the cancel key 207, and a display window 232 at a position corresponding to the display portion 201. Further, the case member 205 has a button hole 233 at a position corresponding to the upper menu key 208, the lower menu key 209, the enter key 210, and the back key 211. The button hole 233 is one single hole without a separation between the upper menu key 208, the lower menu key 209, the enter key 210, and the back key 211.

Figure 7:
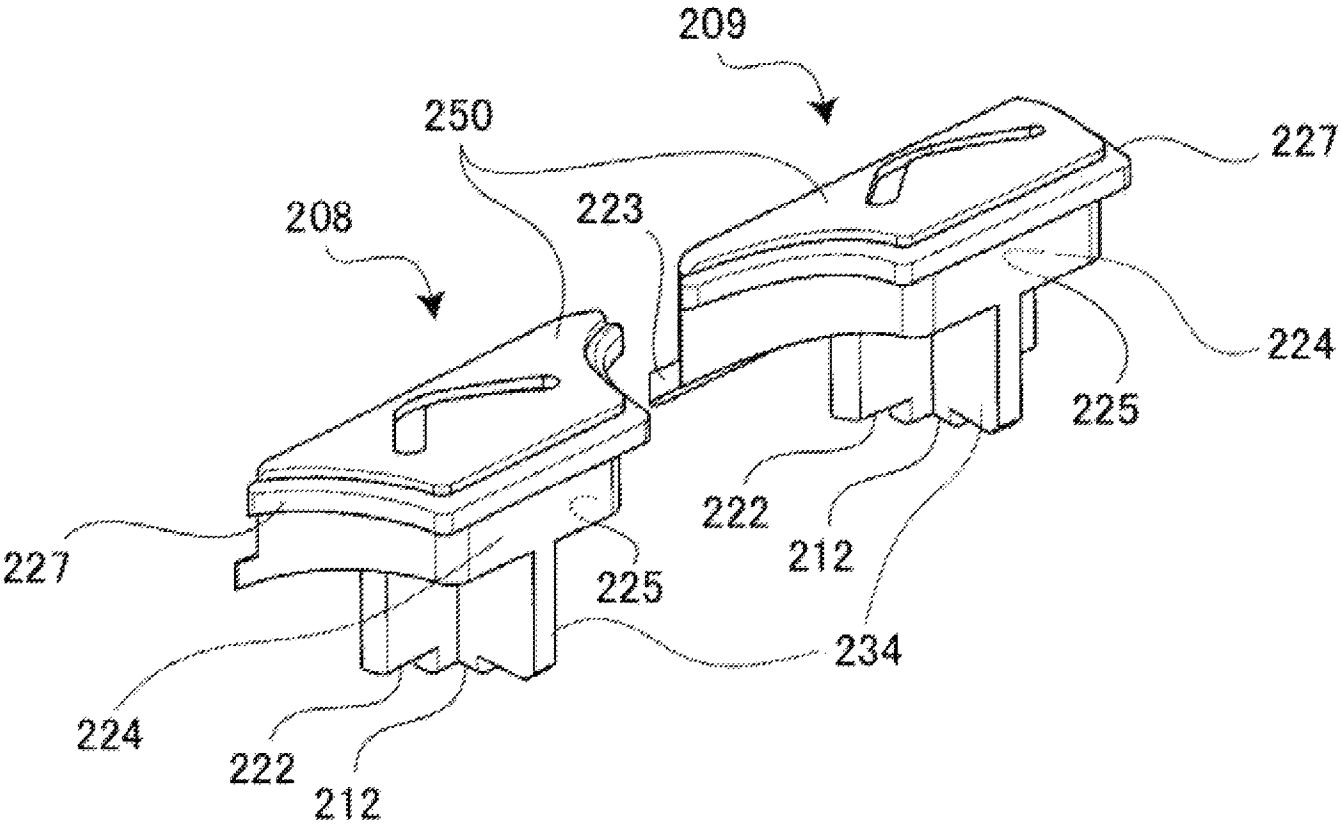
FIG. 7 is a perspective view showing a button-key according to the first embodiment of the present invention.

The button-keys will be explained next in more detail. Each of the button-keys has a similar structure, and the upper menu key 208 and the lower menu key 209 will be explained as an example with reference to FIG. 7. FIG. 7 is a perspective view showing the button-key according to the first embodiment of the present invention.

As shown in FIG. 7, each of the upper menu key 208 and the lower menu key 209 includes a pressing portion 212 for pushing the switch 235 disposed on the circuit board 204 at a lower portion thereof. Further, each of the upper menu key 208 and the lower menu key 209 includes a push-up portion 222 for abutting against a push-up arm 220 of the button-key supporting portion 217 (described later) at the lower portion thereof.

In the embodiment, each of the upper menu key 208 and the lower menu key 209 further includes a protruding portion 227 on a contact surface 250 thereof for covering an upper portion of an adjacent component guide 218 of the button-key supporting portion 217 (described later). The contact surface 250 of each of the upper menu key 208 and the lower menu key 209 is formed in an arc shape similar to an outer shape of the case member 205.

In the embodiment, each of the upper menu key 208 and the lower menu key 209 further includes a sliding rib 234 at a lower portion of a button outer wall 224, and the sliding rib 234 has a surface flush with the button outer wall 224. Each of the upper menu key 208 and the lower menu key 209 further includes a flange portion 223 at an obliquely upper portion of the push-up portion 222, and the flange portion 223 functions as an abutting portion for abutting against the case member 205 through an elastic force of the push-up arm 220 of the button-key supporting portion 217 applied to the push-up portion 222.

Figure 8:
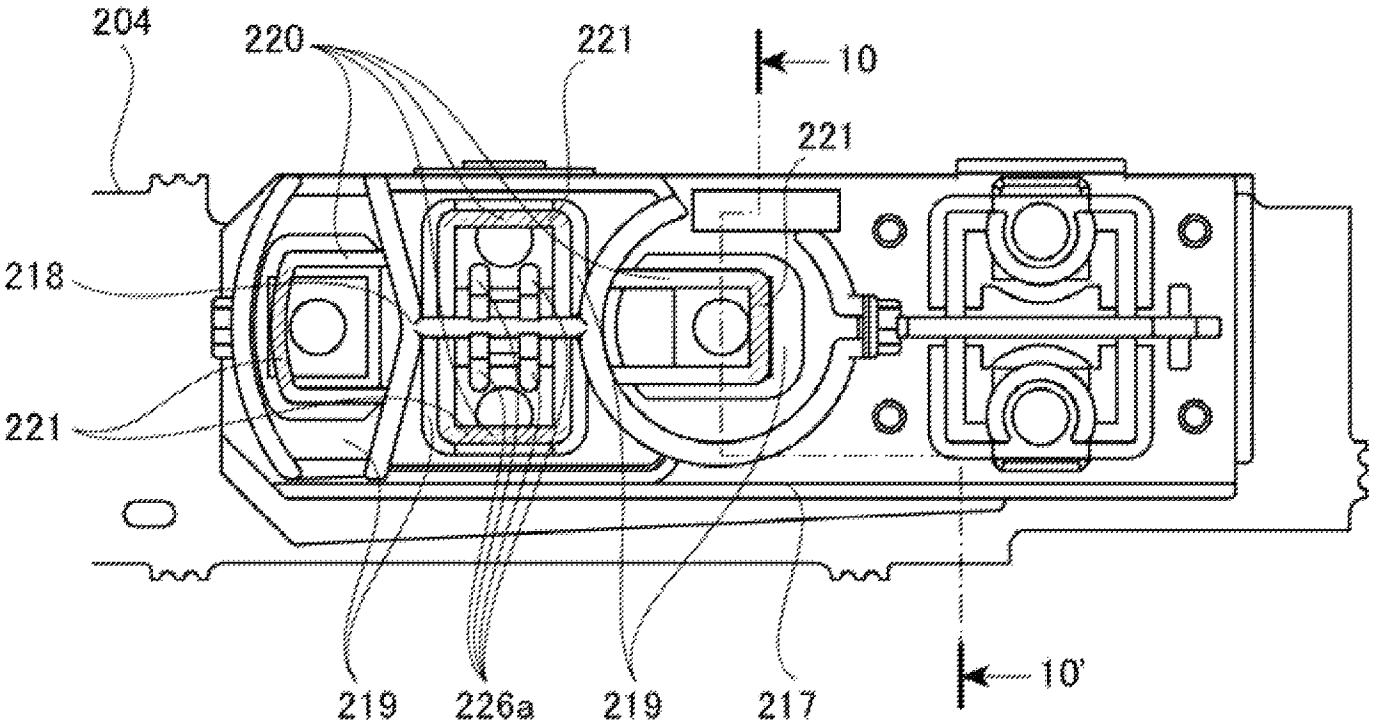
FIG. 8 is a plan view showing a button-key supporting portion according to the first embodiment of the present invention.
Figure 9A:
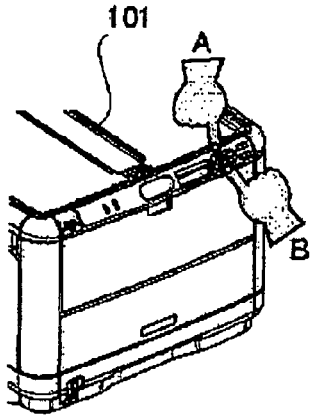
FIGS. 9(*a*) and 9(*b*) are views showing an entire supporting structure of the button-key structure according to the first embodiment of the present invention.
Figure 9B:
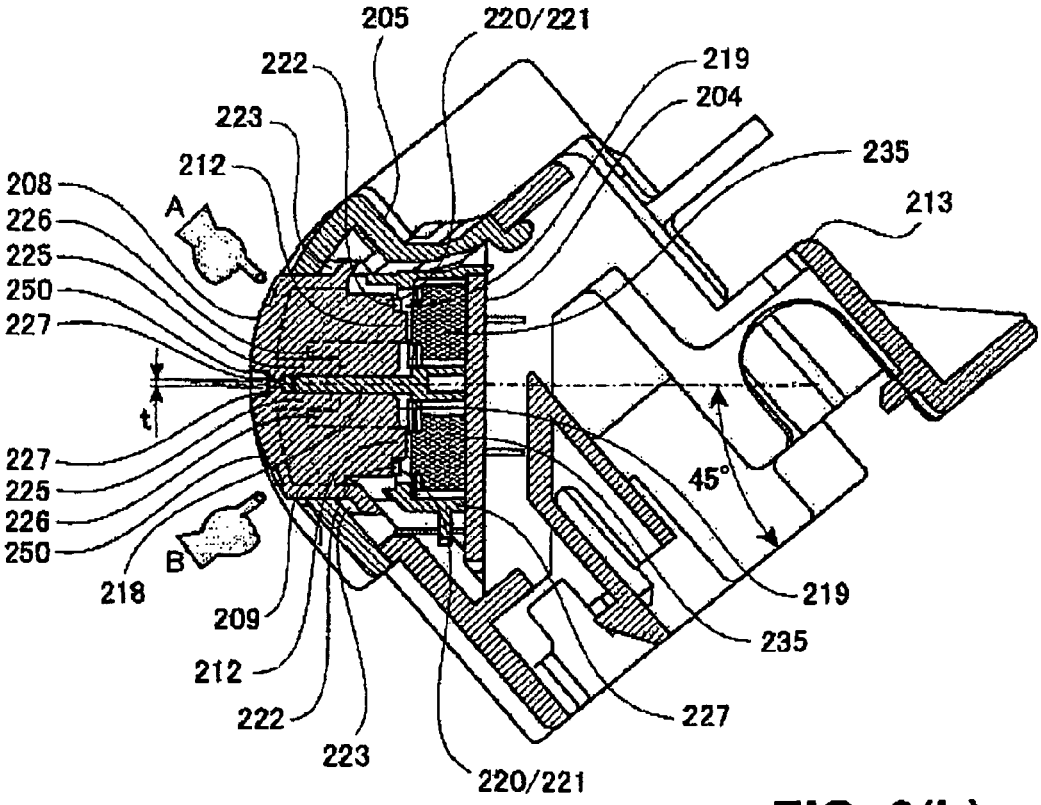

FIG. 8 is a plan view showing the button-key supporting portion 217 according to the first embodiment of the present invention. FIGS. 9(*a*) and 9(*b*) are views showing an entire supporting structure of the button-key structure according to the first embodiment of the present invention.

As shown in FIGS. 4, 6, 8, and 9(*a*)-9(*b*), the button-key supporting portion 217 includes the adjacent component guide 218 for arranging the upper menu key 208, the lower menu key 209, the enter key 210, and the enter key 210 next to each other with a specific space therebetween. Further, the button-key supporting portion 217 includes a button guide 226 integrated with the adjacent component guide 218 for sandwiching the button outer walls 224 and button inner walls 225 opposite to the button outer walls 224 of the upper menu key 208 and the lower menu key 209.

In the embodiment, the button-key supporting portion 217 further includes through holes 219 and the push-up arms 220. As shown in FIGS. 4 and 6, the button-keys are arranged within a plan view projected area (depth D×width W) similar to a surface area of the button-key supporting portion 217.

In the embodiment, the adjacent component guide 218 is arranged such that a surface of the adjacent component guide 218 extends in parallel to a direction that the switches 235 of the circuit board 204 are pushed, so that the button outer walls of the button-keys such as the upper menu key 208 and the lower menu key 209 slide against the surface of the adjacent component guide 218 to move the button-keys in parallel to the direction that the switches 235 of the circuit board 204 are pushed.

As shown in FIG. 9, when the button-keys such as the upper menu key 208 and the lower menu key 209 are installed, the protruding portions 227 of the button-keys such as the upper menu key 208 and the lower menu key 209 cover the upper portion of the adjacent component guide 218, so that the adjacent component guide 218 becomes invisible from outside. Note that the adjacent component guide 218 is arranged between the button-keys to function as a separation wall for preventing the button-keys from contacting with each other.

In the embodiment, similar to the adjacent component guide 218, the button guide 226 is arranged such that a surface of the button guide 226 extends in parallel to the direction that the switches 235 of the circuit board 204 are pushed, so that the button inner walls of the button-keys such as the upper menu key 208 and the lower menu key 209 slide against the surface of the button guide 226 to move the button-keys in parallel to the direction that the switches 235 of the circuit board 204 are pushed. The button guide 226 includes sandwiching portions 226*a* as branch portions thereof extending from the adjacent component guide 218 in the direction that the switches 235 are pushed, so that the button guide 226 sandwiches the button inner walls of the button-keys.

As shown in FIG. 9(*b*), the button-key structure has a space t. The space t is determined according to an arrangement of the adjacent component guide 218 and the button guide 226 disposed in the button-key supporting portion 217; thicknesses of the adjacent component guide 218 and the button guide 226; thicknesses of the button-keys; and a width of the protruding portions 227 of the button-keys.

In the embodiment, the button-keys are arranged such that the button-keys are away from the adjacent component guide 218 and the button guide 226 of the button-key supporting portion 217, so that the button-keys move toward the switches 235. Accordingly, depending on a pushing direction, the button-keys may move in a direction other than toward the switches 235. To this end, the space t is set so that the button-keys arranged next to each other do not contact with each other regardless of the pushing direction.

In particular, in the embodiment, the adjacent component guide 218 is arranged between the button-keys arranged next to each other, so that the adjacent component guide 218 restricts one of the button-keys arranged next to each other from moving toward another of the button-keys arranged next to each other. Accordingly, it is possible to prevent one of the button-keys arranged next to each other from contacting with another of the button-keys to be pushed when one of the button-keys arranged next to each other is pushed.

Further, in the embodiment, the sandwiching portions 226*a* of the button guide 226 and the adjacent component guide 218 sandwich the button inner walls of the button-keys to prevent the button-keys from being inclined toward the pushing direction. Accordingly, it is possible to move the button-keys linearly toward the switches 235 to be pushed. As a result, it is possible to minimize the space between the button keys and the space t.

In the embodiment, the through holes 219 function as a moving space for the push-up arms 220 to freely deform when the push-up arms 220 abut against the push-up portions 222 disposed at the lower portions of the upper menu key 208 and the lower menu key 209 at specific positions. As shown in FIG. 8, effective points 221 are defined as the specific positions where the push-up arms 220 abut against the push-up portions 222 disposed at the lower portions of the upper menu key 208 and the lower menu key 209.

In the embodiment, the push-up arms 220 extend from a base portion of the adjacent component guide 218 toward the flange portions 223 of the upper menu key 208 and the lower menu key 209. As described above, the flange portions 223 are arranged to abut against a circumferential edge of the button hole 233 of the case member 205 from inside. Accordingly, when the push-up arms 220 abut against the push-up portion 222 at the effective points 221, the push-up arms 220 deform. A deformation amount of the push-up arms 220 is not limited to any specific level, and is set to 0.2 mm in the embodiment in consideration of mechanical strength of the push-up arms 220 and pushing feeling with respect to the operator.

Figure 10:
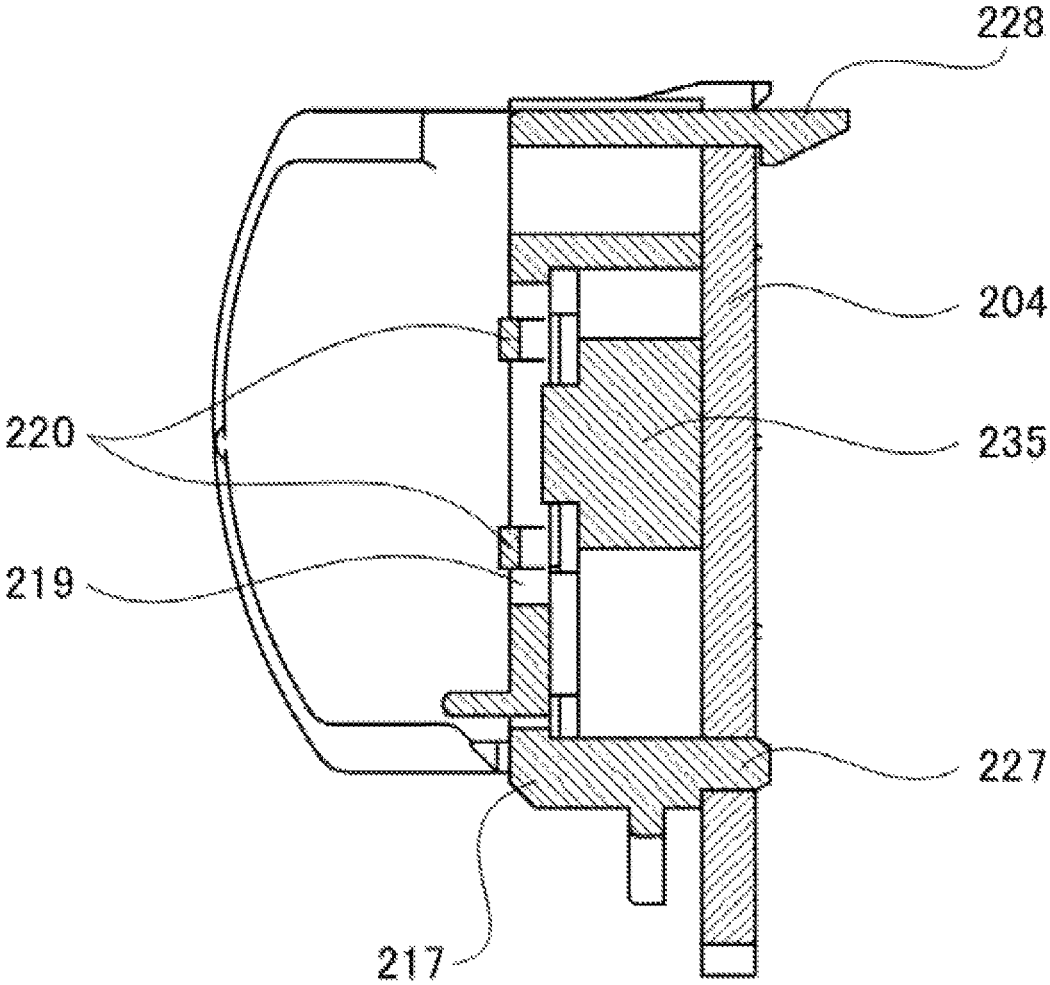
FIG. 10 is a schematic sectional view showing the entire supporting structure of the button-key structure taken along a line 10-10' in FIG. 8 according to the first embodiment of the present invention.
Figure 11:
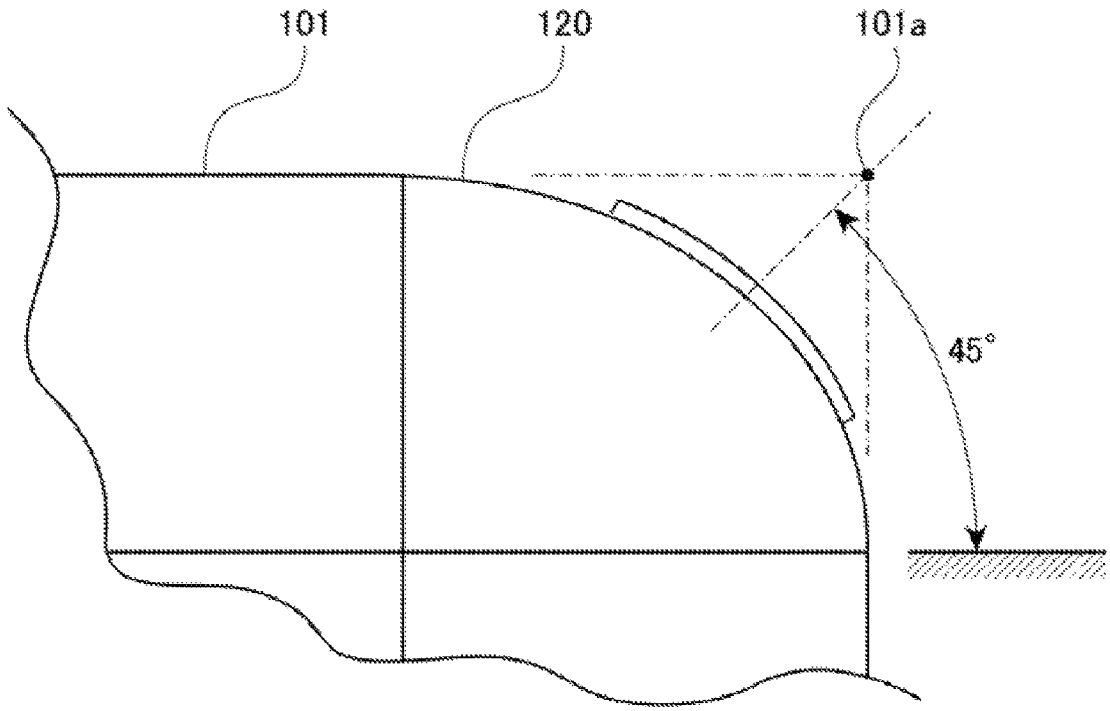
FIG. 11 is a schematic enlarged view of a portion A in FIG. 2 showing the entire supporting structure of the button-key structure according to the first embodiment of the present invention.

The entire supporting structure of the button-key structure will be explained with reference to FIGS. 9 to 13. FIG. 9 is a sectional view taken along a line 9-9' in FIG. 4. FIG. 10 is a schematic sectional view showing the entire supporting structure of the button-key structure taken along a line 10-10' in FIG. 8 according to the first embodiment of the present invention. FIG. 11 is a schematic enlarged view of a portion A in FIG. 2 showing the entire supporting structure of the button-key structure according to the first embodiment of the present invention.

Figure 12:
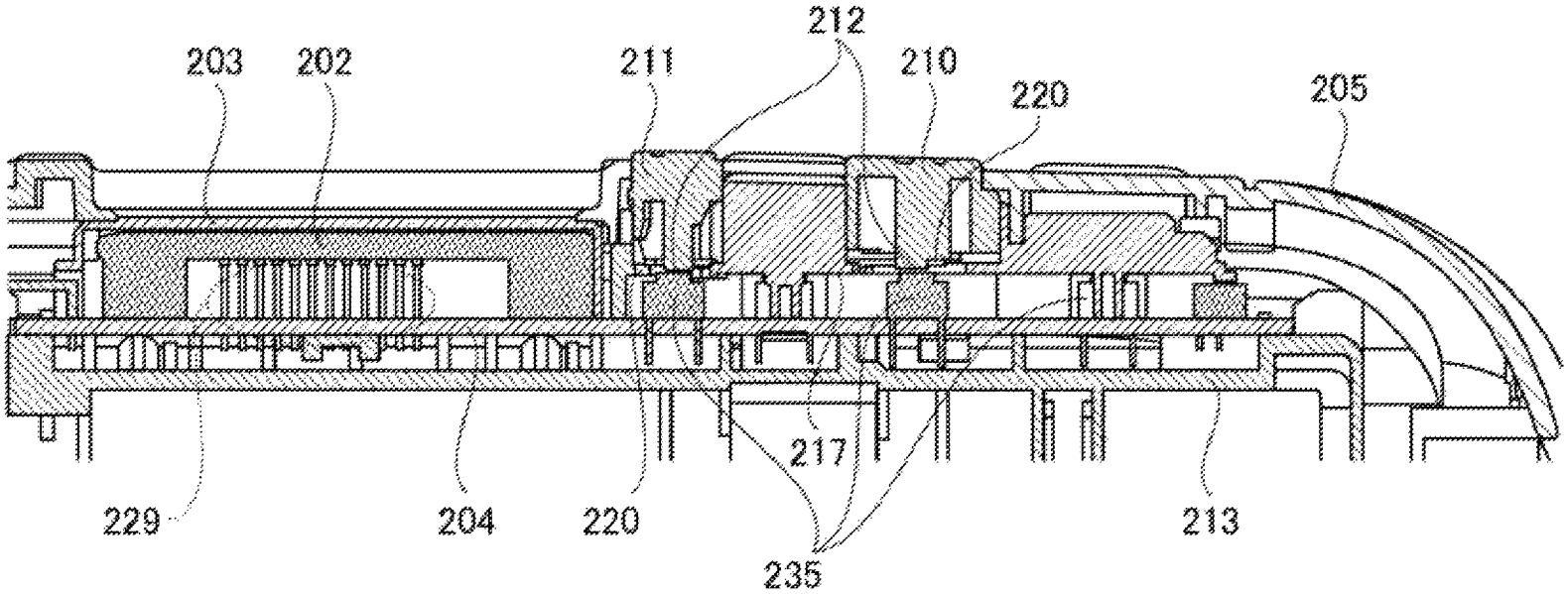
FIG. 12 is a sectional view No. 1 showing the entire supporting structure of the button-key structure taken along a line 12-12' in FIG. 4 according to the first embodiment of the present invention.
Figure 13:
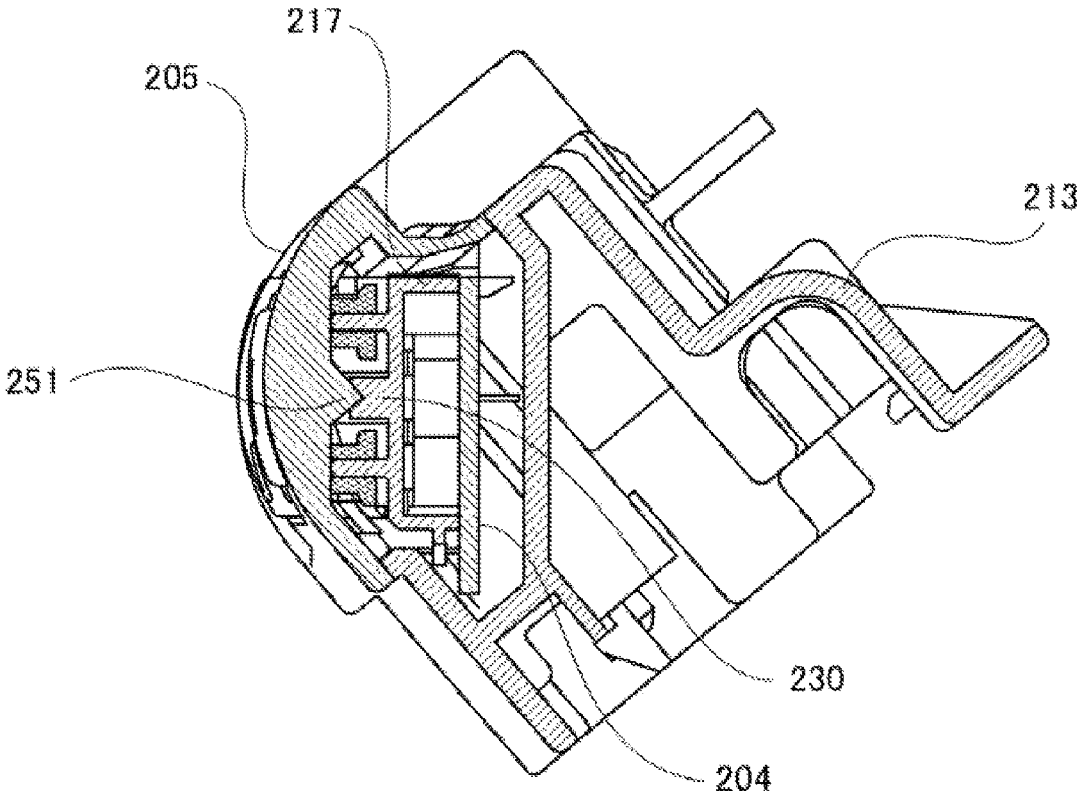
FIG. 13 is a sectional view No. 2 showing the entire supporting structure of the button-key structure taken along a line 13-13' in FIG. 4 according to the first embodiment of the present invention.

FIG. 12 is a sectional view No. 1 showing the entire supporting structure of the button-key structure taken along a line 12-12' in FIG. 4 according to the first embodiment of the present invention. FIG. 13 is a sectional view No. 2 showing the entire supporting structure of the button-key structure taken along a line 13-13' in FIG. 4 according to the first embodiment of the present invention.

As shown in FIG. 9, the key-button structure has a laminated structure of the case member 205, the button-keys, the button-key supporting portion 217, and the circuit board 204 laminated in this order from outside. The button-keys are arranged such that the button-keys protrude outward from the case member 205 by a specific amount (about 1 mm in the embodiment). Further, the button-keys are arranged at the positions such that the pressing portions 212 formed at the lower portions of the button-keys abut against or contact with the switches 235 disposed on the circuit board 204.

In the embodiment, the button-keys are arranged with the specific space therebetween through the adjacent component guide 218. It is possible to adjust the space t between the button-keys through adjusting dimensions of the adjacent component guide 218 and the button outer walls 224. The space t is set to 0.8 mm in the embodiment.

As shown in FIG. 10, the button-key supporting portion 217 includes a positioning post 227 for positioning, and a fixing claw 228 for fixing to the circuit board 204. As shown in FIGS. 9 and 12, in a state that the button-key supporting portion 217 holds the button-keys and the circuit board 204, the button-key supporting portion 217 is mounted on a frame member 213 at a mounting angle to be set at a specific angle relative to an apparatus bottom surface. The mounting angle is set to 45 degrees in the embodiment in consideration of high visibility of the display portion 201 toward the operator and operability of the operation panel 120.

As described above, the switches 235 are disposed on the circuit board 204 at the positions corresponding to the button-keys. As shown in FIG. 12, an LCD portion 202 is connected to the circuit board 204 through a terminal portion 229. The display cover 203 covers a display surface of the LCD portion 202, and is integrated with the button-key supporting portion 217.

As shown in FIG. 13, when a positioning rib 251 formed on a case frame member 213 is fitted in a positioning groove 230 formed in the button-key supporting portion 217, the case member 205 holds the circuit board 204 integrated with the button-key supporting portion 217. Accordingly, the upper menu key 208, the lower menu key 209, the enter key 210, and the back key 211 are positioned and held.

Figure 14:
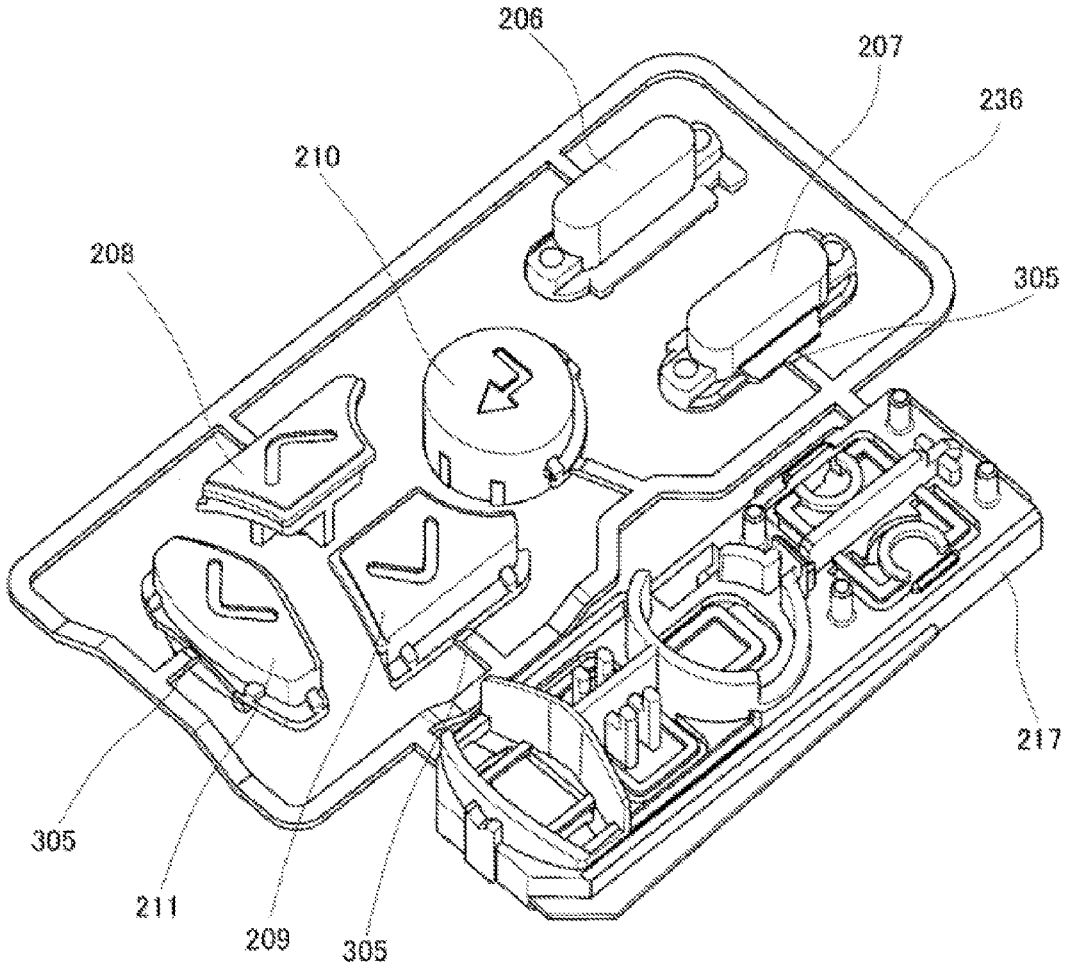
FIG. 14 is a perspective view showing an integrated structure of the button-key and the button-key supporting portion according to the first embodiment of the present invention.

FIG. 14 is a perspective view showing an integrated structure of the button-key and the button-key supporting portion 217 according to the first embodiment of the present invention. As shown in FIG. 14, it is possible to integrally produce the button-key supporting portion 217 and the button-keys such as the online key 206, the cancel key 207, the upper menu key 208, the lower menu key 209, the enter key 210, and the back key 211 as a single part integrated through a frame 236. Each component is connected to the frame 236 through a connecting portion 305 having a thickness gradually decreasing like a beam. When the button-keys and the button-key supporting portion 217 are assembled, the button-keys and the button-key supporting portion 217 are separated at the connecting portions 305 of the frame 236, and the button-keys are installed in the button-key supporting portion 217.

An operation of the button-key structure will be explained next. When the operator selects the print number or the setting of the sheet, the operator pushes one of the upper menu key 208, the lower menu key 209, the enter key 210, and the back key 211 on the operation panel 120 shown in FIG. 3.

As shown in FIG. 11, the operation panel 120 is arranged on a ridge line 101*a* at a front upper portion of the printer 101. Accordingly, the operator operates the button-keys while sitting or standing. Note that the outer surface of the case member 205 has an arc shape with a small curvature. Accordingly, as shown in FIG. 9, the operator pushes one of the button-keys in a direction A while standing, and in a direction B while sitting.

Figure 15:
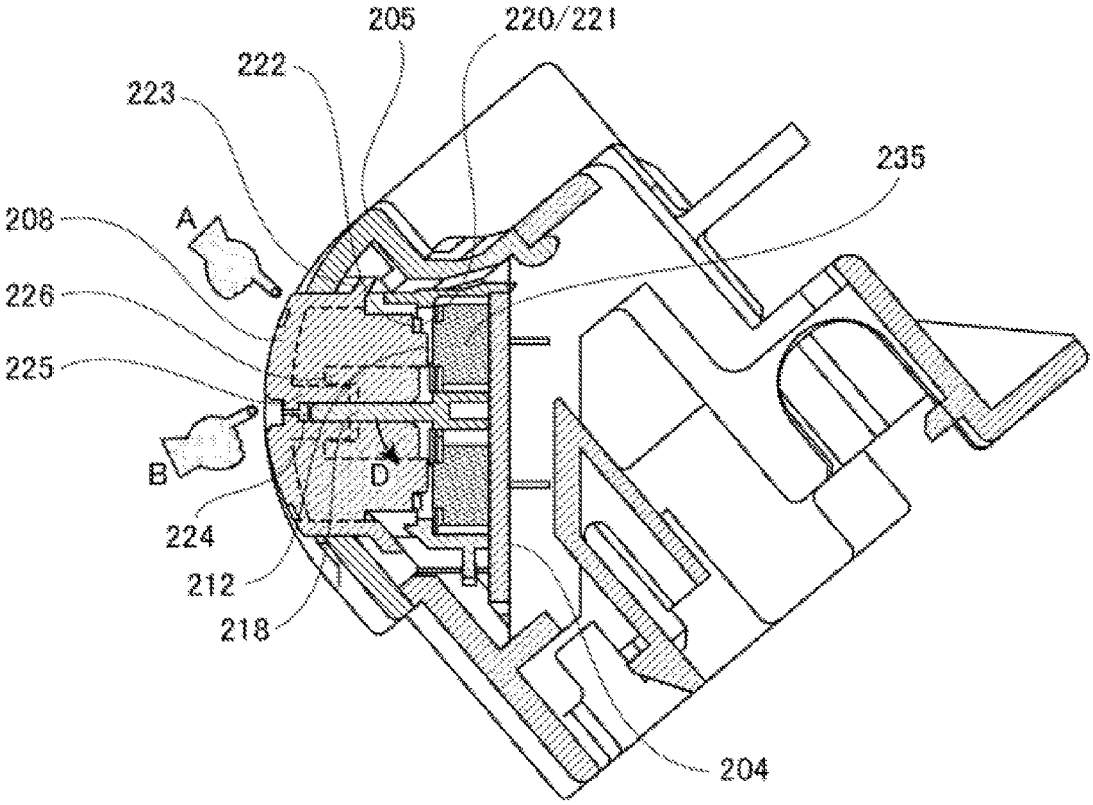
FIG. 15 is a sectional view No. 1 showing an operation of the button-key structure according to the first embodiment of the present invention.

FIG. 15 is a sectional view No. 1 showing the operation of the button-key structure according to the first embodiment of the present invention. As shown in FIG. 15, when the operator pushes the upper menu key 208 in the direction A, the upper menu key 208 rotates in an arrow direction D around the effective point 221 due to an elastic force applied to the push-up portion 222 at the effective point 221 of the push-up arm 220. As a result, the button outer wall 224 and the sliding rib 234 abut against the adjacent component guide 218, and the upper menu key 208 moves along the surface of the adjacent component guide 218, so that the pressing portion 212 pushes the switch 235.

When the operator pushes the upper menu key 208 in the direction B, the upper menu key 208 rotates in the arrow direction D around the effective point 221 due to the elastic force applied to the push-up portion 222 at the effective point 221 of the push-up arm 220. As a result, the button inner wall 225 abuts against the button guide 226 and the button outer wall 224 abuts against the adjacent component guide 218, and the upper menu key 208 moves along the surface of the adjacent component guide 218, so that the pressing portion 212 pushes the switch 235.

Figure 16:
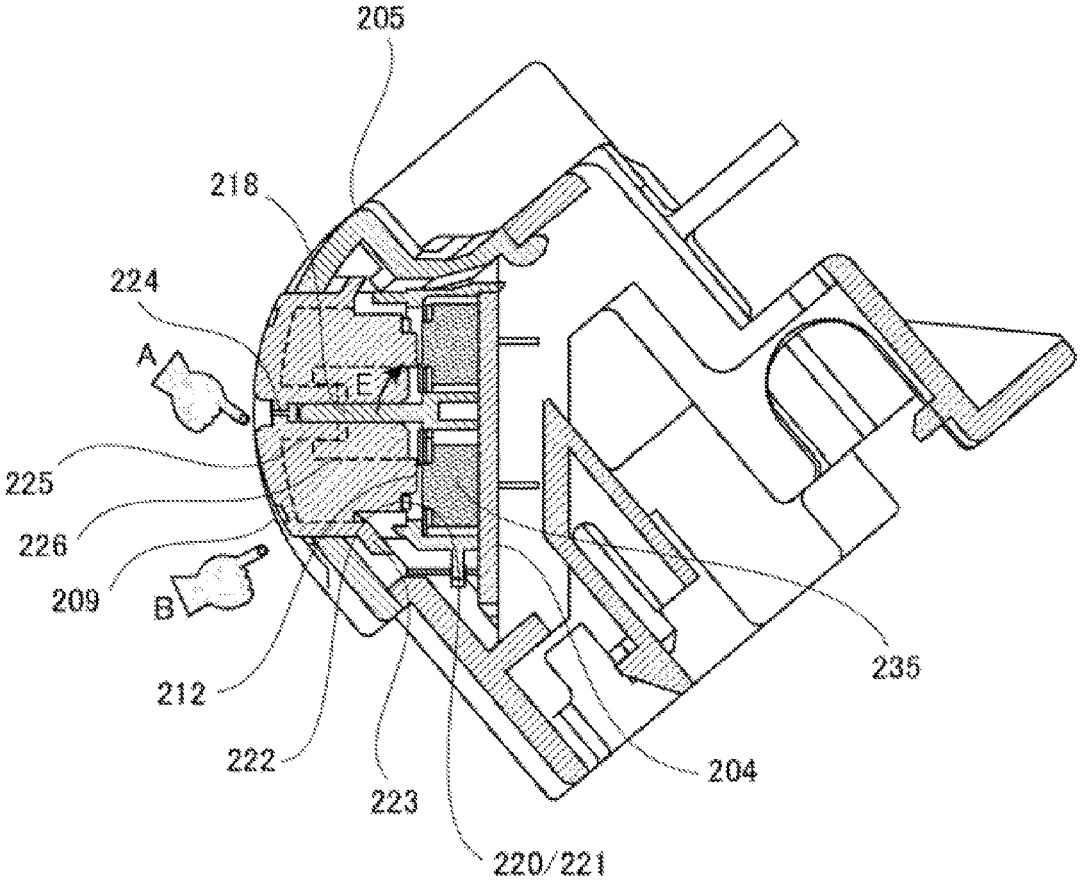
FIG. 16 is a sectional view No. 2 showing the operation of the button-key structure according to the first embodiment of the present invention.

FIG. 16 is a sectional view No. 2 showing the operation of the button-key structure according to the first embodiment of the present invention. As shown in FIG. 16, when the operator pushes the lower menu key 209 in the direction A, the lower menu key 209 rotates in an arrow direction E around the effective point 221 due to an elastic force applied to the push-up portion 222 at the effective point 221 of the push-up arm 220. As a result, the button inner wall 225 abuts against the button guide 226 and the button outer wall 224 abuts against the adjacent component guide 218, and the lower menu key 209 moves along the surface of the adjacent component guide 218, so that the pressing portion 212 pushes the switch 235.

When the operator pushes the lower menu key 209 in the direction B, the lower menu key 209 rotates in the arrow direction E around the effective point 221 due to the elastic force applied to the push-up portion 222 at the effective point 221 of the push-up arm 220. As a result, the button outer wall 224 and the sliding rib 234 abut against the adjacent component guide 218, and the lower menu key 209 moves along the surface of the adjacent component guide 218, so that the pressing portion 212 pushes the switch 235.

Figure 17:
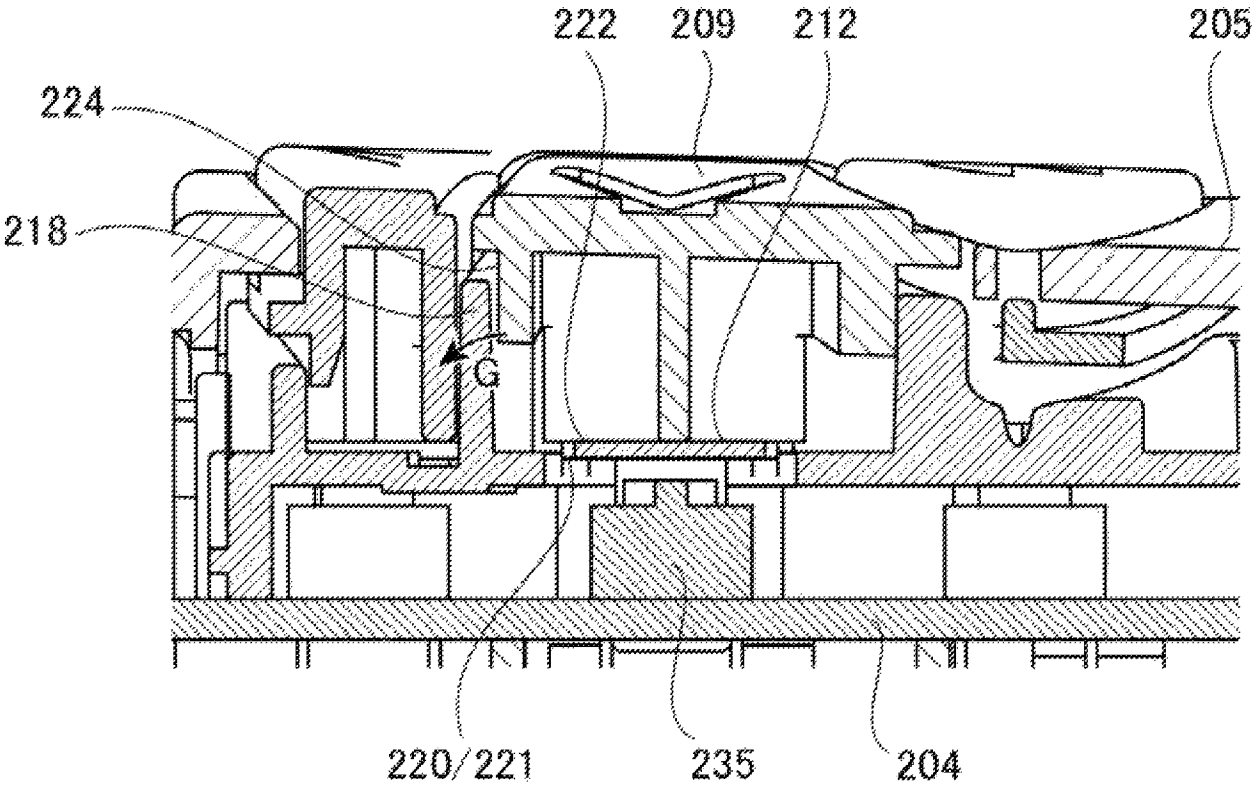
FIG. 17 is a sectional view No. 3 showing the operation of the button-key structure taken along a line 17-17' in FIG. 4 according to the first embodiment of the present invention.

FIG. 17 is a sectional view No. 3 showing the operation of the button-key structure taken along a line 17-17' in FIG. 4 according to the first embodiment of the present invention. As shown in FIG. 17, when the operator pushes one of a left end portion and a right end portion of the lower menu key 209 (the left end portion in the description), the lower menu key 209 rotates in an arrow direction G around the effective point 221 due to an elastic force applied to the push-up portion 222 at the effective point 221 of the push-up arm 220. As a result, the button outer wall 224 abuts against the adjacent component guide 218, and the lower menu key 209 moves along the surface of the adjacent component guide 218, so that the pressing portion 212 pushes the switch 235.

In the embodiment, when the operator pushes one of a left end portion and a right end portion of the upper menu key 208, the upper menu key 208 moves in a way similar to that of the lower menu key 209. Further, the enter key 210 or the back key 211 moves in a way similar to that of the lower menu key 209.

As described above, in the embodiment, the push-up arm 220 for pushing up the button-key is arranged to protrude from the end portion of the adjacent component guide 218 of the button-key supporting portion 217 in the direction that the button-key moves, or toward just below the button-key.

In general, when a button-key with the configuration described above is pushed from above, the button-key rotates around a base portion of the push-up arm 220. In the embodiment, the flange portion 223 is provided on the surface opposite to the surface contacting with the adjacent component guide 218 (the base portion of the push-up portion 222) for abutting against the inner surface of the case member 205. Further, the push-up portion 222 of the push-up arm 220 is arranged near just below the flange portion 223. Accordingly, when the button-key is pushed, the button-key rotates around the flange portion 223 relative to the case member 205.

Accordingly, with the combination of the rotational directions of the push-up arm 220 and the flange portion 223 described above, the push-up arm 220 and the flange portion 223 generate the force for guiding the button-key toward the corresponding switch even when the operator pushes the button-key in any directions. As a result, it is possible to linearly move the button-key relative to the circuit board 204, thereby smoothly pushing the switch 235 on the circuit board 204.

In the embodiment, information according to pushing down the switch is transmitted to the print control unit (not shown) of the printer 101 through the circuit board 204. Then, the print control unit (not shown) controls each component constituting the printer 101 to perform the printing operation according to the setting of the operator.

As described above, in the button-key structure in the embodiment, it is possible to push the button-key in a wide range. When the operator pushes the button-key in any directions, the button-key moves along the surface of the button-key supporting portion 217 toward the switch 235 on the circuit board 204. Accordingly, the button-key thus pushed does not interfere with the adjacent button-key, thereby making it possible to smoothly push the button-key. Further, the sliding rib of the button-key contacts with the button-key supporting portion 217 over a small area, thereby reducing contact resistance and a pushing load during the operation.

Further, in the embodiment, it is possible to image operational feeling upon pushing the button-key and maintain the contact surface on one single surface due to the elastic force applied with the push-up arm 220 of the button-key supporting portion 217. Further, the button-keys are arranged within the plan view projected area (depth D×width W) similar to the surface area of the button-key supporting portion 217. Accordingly, it is possible to arrange the button-keys with a maximum dimension within a mounting area even when the operation panel 120 has a minimum area.

Further, in the embodiment, the button-keys are arranged in a separated independent arrangement, not in an integrated see-saw arrangement, thereby making it possible to concurrently push a plurality of the button-keys. Accordingly, it is possible to select a function through concurrently pushing a plurality of the button-keys such as a special function or a maintenance mode invisible to a general user.

Further, in the embodiment, it is possible to integrally produce the button-key supporting portion 217 and the button-keys as a single part integrated through the frame 236. Accordingly, it is possible to handle the button-keys as a single part just before assembly, thereby reducing the number of steps in parts assembly or maintenance. Further, the button-keys are produced as a single part using a material in a single lot. Accordingly, it is possible to reduce a cost of a mold. Further, it is possible to prevent mismatch in color that tends to occur due to different lots when the button-keys are produced separately. Further, it is possible to easily match color of the button-keys arranged next to each other.

Second Embodiment

A second embodiment of the present invention will be explained. A button-key structure in the second embodiment is similar to that in the first embodiment. Only difference from the first embodiment will be explained.

The button-keys will be explained next. Each of the button-keys has a similar structure, and an upper menu key 208' and a lower menu key 209' will be explained as an example with reference to FIGS. 18 and 19(*a*)-19(*b*).

Figure 18:
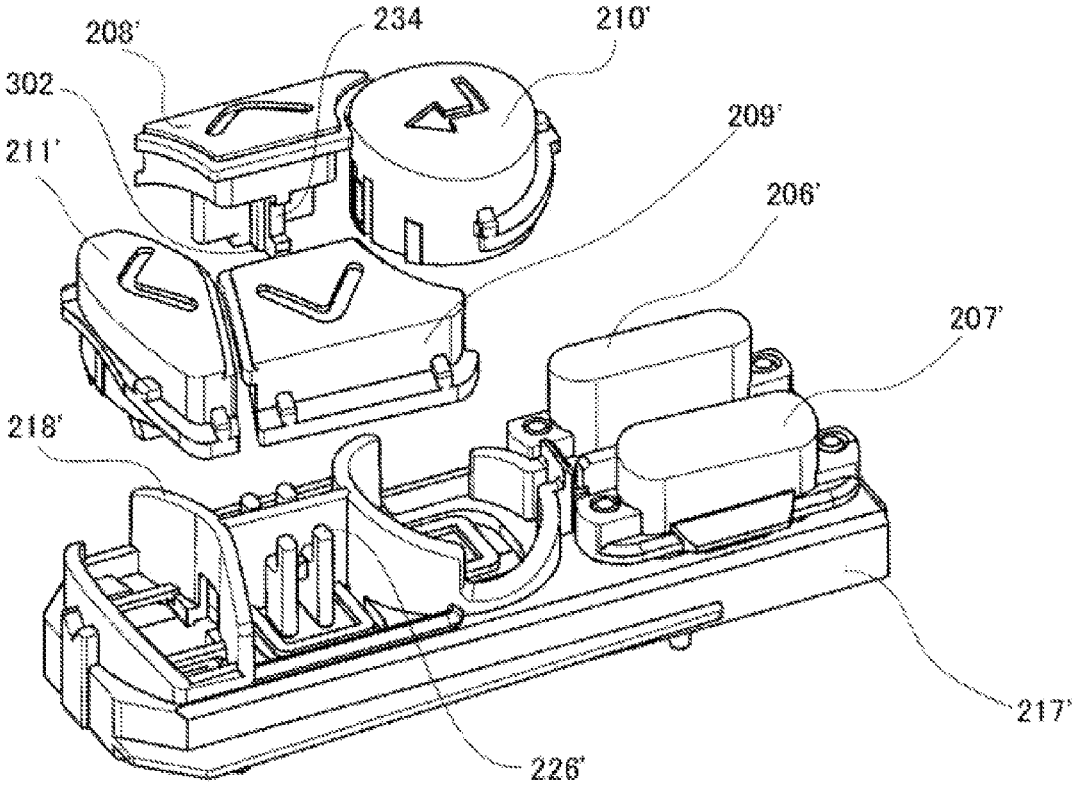
FIG. 18 is a perspective view showing a button-key structure according to a second embodiment of the present invention.
Figure 19A:
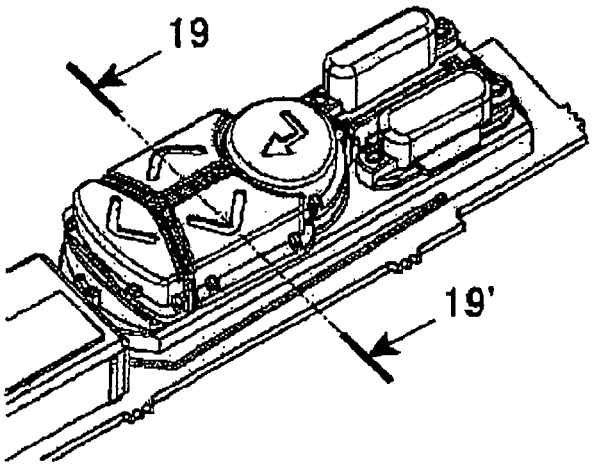
FIG. 19(*a*) is a view showing the button-key structure according to the second embodiment of the present invention.
Figure 19B:
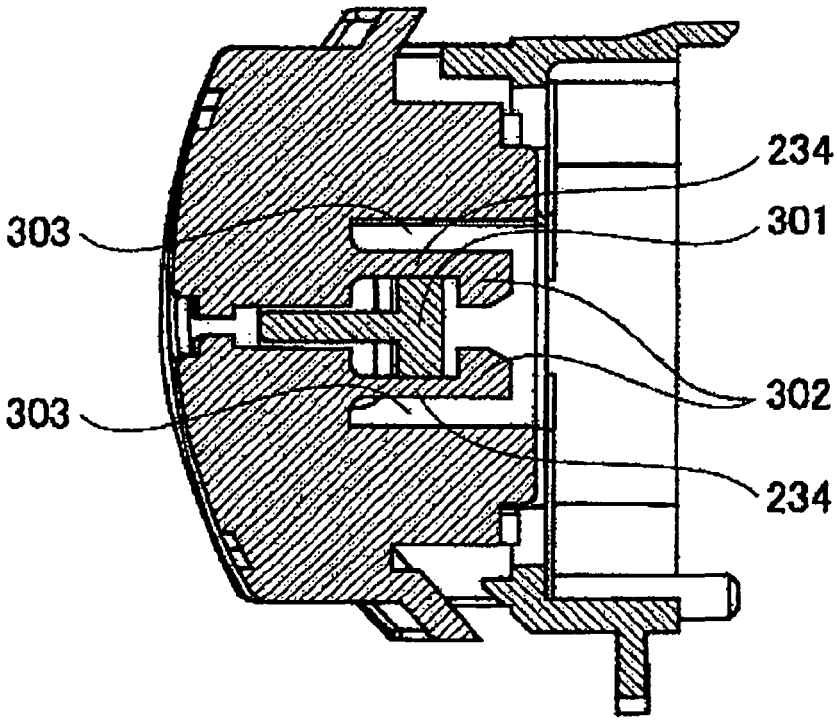

FIG. 18 is a perspective view showing the button-key structure according to the second embodiment of the present invention. FIG. 19(*a*) is a view showing the button-key structure according to the second embodiment of the present invention. 19(*b*) is a view showing an entire supporting structure of the button-key structure taken along a line 19-19' in FIG. 19(*a*) according to the second embodiment of the present invention.

As shown in FIGS. 18 and 19(*a*)-19(*b*), in addition to the components in the first embodiment, each of the upper menu key 208' and the lower menu key 209' includes a protruding portion 302 integrated at a lower portion of the sliding rib 234.

In the embodiment, in addition to the components in the first embodiment, a button-key supporting portion 217' includes fixing holes 301 at a base portion of a button guide 226' of an adjacent component guide 218' for engaging the protruding portions 302 of the upper menu key 208' and the lower menu key 209'. Further, the button-key supporting portion 217' includes slit portions 303 as a moving space for the protruding portions 302 to freely deform.

An operation of the button-key structure will be explained next. In the following description, an operation of attaching the button-keys to the button-key supporting portion 217' will be explained.

When the upper menu key 208' and the lower menu key 209' are installed in the adjacent component guide 218' of the button-key supporting portion 217', the protruding portion 302 of the upper menu key 208' or the lower menu key 209' abuts against the adjacent component guide 218'. Accordingly, the protruding portion 302 is inserted while deforming toward the slit portion 303.

Just before the upper menu key 208' is the lower menu key 209' is inserted into a standard position, the protruding portion 302 reaches the fixing hole 301. Then, the deformation of the protruding portion 302 due to abutting against the adjacent component guide 218' is released, so that the protruding portion 302 engages the fixing hole 301.

In the embodiment, the button-keys have the protruding portions 302, and the button-key supporting portion 217' includes the slit portions 303. Alternatively, the button-keys may have the slit portions 303, and the button-key supporting portion 217' includes the protruding portions 302.

The operation of the button-key structure is substantially the same as that in the first embodiment, and an explanation thereof is omitted. In the second embodiment, the push-up arm 220 and the flange portion 223 generate the force for guiding the button-key toward the corresponding switch even when the operator pushes the button-key in any directions. As a result, it is possible to linearly move the button-key relative to the circuit board 204, thereby smoothly pushing the switch 235 on the circuit board 204.

As described above, in the second embodiment, the protruding portion 302 engages the fixing hole 301, so that the button-key does not come off the button-key supporting portion 217'. Accordingly, it is possible to prevent the button-key from coming off during the assembly process, thereby improving operation efficiency during the assembly process.

In the embodiments described above, the button-key structure has four button-keys, and the invention is not limited thereto. Further, the button-keys arranged next to each other are separated into four pieces having an oval shape, and are not limited thereto. As far as the button-keys are arranged next to each other, the button-keys may have any shape.

Further, in the embodiments described above, the operation panel of the printer is explained as an example. The present invention is applicable to other electric devices such as a copier, a facsimile, a personal computer, a telephone, a game machine, and the likes.

The disclosure of Japanese Patent Application No. 2008-289478, filed on Nov. 12, 2008, is incorporated in the application by the reference.

While the invention has been explained with reference to the specific embodiments of the invention, the explanation is illustrative and the invention is limited only by the appended claims.

What is claimed is:

1. A button-key structure, comprising:

a plurality of button-keys arranged next to each other;

a sliding rib disposed on at least one of the button-keys on a downstream side in a direction that the button-keys are pushed;

a button-key supporting portion disposed on the downstream side in the direction that the button-keys are pushed, said button-key supporting portion including a guide portion disposed between the button-keys substantially in parallel to the direction that the button-keys are pushed, said button-key supporting portion further including a through hole facing at least one of the button-keys and a pushup arm disposed in the through hole for pushing up the one of the button-keys; and a button guide having a surface substantially parallel to the sliding rib and disposed to slidably engage with the sliding rib and an inner wall of each of the button-keys, wherein said guide portion is formed to have a length smaller than a length of each of the button-keys from a finger contact surface thereof to a contact portion thereof with the pushup arm, and said button-keys are arranged away from each other with a specific space in between at an upper portion thereof.

2. The button-key structure according to claim 1, wherein said pushup arm is arranged to protrude from the guide portion.

3. The button-key structure according to claim 1, further comprising a cover member on an upstream side in the direction that the button-keys are pushed.

4. The button-key structure according to claim 3, wherein said button-keys include an abutting portion on a side opposite to the guide portion for abutting against the cover member.

5. The button-key structure according to claim 1, wherein said button-keys include an engaging portion, said guide portion including an engaged portion for engaging the engaging portion.

6. The button-key structure according to claim 5, wherein said engaging portion is formed in a hook shape, said engaged portion being formed in a slit shape.

7. The button-key structure according to claim 1, wherein said button-keys are integrated with the button-key supporting portion through a frame member.

8. The button-key structure according to claim 1, wherein said sliding rib is integrated with at least the one of the button-keys.

9. An electric device comprising:

a button-key structure, said button-key structure including a plurality of button-keys arranged next to each other, a sliding rib disposed on at least one of the button-keys on a downstream side in a direction that the button-keys are pushed, and a button-key supporting portion disposed on the downstream side in the direction that the button-keys are pushed, said button-key supporting portion including a guide portion disposed between the button-keys substantially in parallel to the direction that the button-key are pushed, said button-key supporting portion further including a through hole facing at least one of the button-keys and a pushup arm disposed in the through hole for pushing up the one of the button-keys, and a button guide having a surface substantially parallel to the sliding rib and disposed to slidably engage with the sliding rib and an inner wall of each of the button-keys, wherein said guide portion is formed to have a length smaller than a length of each of the button-keys from a finger contact surface thereof to a contact portion thereof with the pushup arm, and said button-keys are arranged away from each other with a specific space in between at an upper portion thereof.

10. The electric device according to claim 9, wherein said pushup arm is arranged to protrude from the guide portion.

11. The electric device according to claim 9, further comprising a cover member on an upstream side in the direction that the button-keys are pushed.

12. The electric device according to claim 11, wherein said button-keys include an abutting portion on a side opposite to the guide portion for abutting against the cover member.

13. The electric device according to claim 9, wherein said button-keys include an engaging portion, said guide portion including an engaged portion for engaging the engaging portion.

14. The button-key structure according to claim 13, wherein said engaging portion is formed in a hook shape, said engaged portion being formed in a slit shape.

15. The electric device according to claim 9, further comprising a circuit board with a switch on a downstream side in the direction that the button-keys are pushed.

16. The electric device according to claim 9, wherein said sliding rib is integrated with at least the one of the button-keys.

17. A button-key structure, comprising:

a first button-key arranged to be pushed in a first moving direction;

a second button-key arranged adjacent to the first button-key to be movable in the first moving direction;

a sliding rib disposed on at least one of the first button-key and the second button-key on a downstream side in the first moving direction;

a button-key supporting portion disposed on the downstream side of the first button-key and the second button-key in the first moving direction, said button-key supporting portion including a separation wall disposed between the first button-key and the second button-key, said separation wall extending in the first moving direction, said button-key supporting portion further including a through hole facing at least one of the button-keys and a pushup arm disposed in the through hole for pushing up the one of the button-keys; and a button guide having a surface substantially parallel to the sliding rib and disposed to slidably engage with the sliding rib and an inner wall of each of the button-keys, wherein said guide portion is formed to have a length smaller than a length of each of the button-keys from a finger contact surface thereof to a contact portion thereof with the pushup arm, and said button-keys are arranged away from each other with a specific space in between at an upper portion thereof.

18. The button-key structure according to claim 17, wherein said sliding rib is integrated with at least the one of the button-keys.

* * * * *